US009546467B2

(12) United States Patent
Paski

(10) Patent No.: US 9,546,467 B2
(45) Date of Patent: Jan. 17, 2017

(54) SCREENED EARTH MOVING BUCKET WITH VIBRATING BARS

(71) Applicant: Pohmako Ky, Isokoski (FI)

(72) Inventor: Eero Paski, Isokoski (FI)

(73) Assignee: Pohmako Ky, Isokoski (FI)

( * ) Notice: Subject to any disclaimer, the term of this patent is extended or adjusted under 35 U.S.C. 154(b) by 0 days.

(21) Appl. No.: 14/432,385

(22) PCT Filed: Sep. 27, 2013

(86) PCT No.: PCT/FI2013/050942
§ 371 (c)(1),
(2) Date: Mar. 30, 2015

(87) PCT Pub. No.: WO2014/053698
PCT Pub. Date: Apr. 10, 2014

(65) Prior Publication Data

US 2015/0252550 A1 Sep. 10, 2015

(30) Foreign Application Priority Data

Oct. 1, 2012 (FI) ..... 20126017

(51) Int. Cl.
*E02F 3/40* (2006.01)
*B07B 1/12* (2006.01)
(Continued)

(52) U.S. Cl.
CPC . *E02F 3/40* (2013.01); *B07B 1/12* (2013.01); *E02F 3/405* (2013.01); *E02F 3/407* (2013.01); *E02F 7/06* (2013.01)

(58) Field of Classification Search
CPC ..... E02F 3/40; E02F 3/405; E02F 3/407; E02F 3/06; E02F 7/06; B07B 1/12; B07B 1/00; B07B 1/16; B07B 1/28–1/40
(Continued)

(56) References Cited

U.S. PATENT DOCUMENTS 683,775 A * 10/1901 Kirkpatrick ..... E21C 41/26 209/419
3,003,265 A * 10/1961 Lutjens ..... E02F 3/404 209/394
(Continued)

FOREIGN PATENT DOCUMENTS

EP 1369535 12/2003
JP 05187034 A * 7/1993
(Continued)

OTHER PUBLICATIONS

Office Action for FI20126017 dated Jun. 11, 2013.
(Continued)

*Primary Examiner* — Thomas B Will
*Assistant Examiner* — Joan D Misa
(74) *Attorney, Agent, or Firm* — Andrus Intellectual Property Law, LLP

(57) ABSTRACT

A screened earth-moving bucket with vibration. The bucket includes a bottom, side plates, a back plate, and an attachment for connecting to a work machine. The bucket also includes at least one screen part having a plurality of adjacent bars to form a screen. At least one bar included in the screen part is vibrated by a vibrator unit so that the vibrated bar moves in relation to the bucket.

9 Claims, 3 Drawing Sheets

(51) Int. Cl.
*E02F 7/06* (2006.01)
*E02F 3/407* (2006.01)

(58) Field of Classification Search
USPC ..... 37/444; 460/101, 102, 902
See application file for complete search history.

(56) References Cited

U.S. PATENT DOCUMENTS 3,072,257 A * 1/1963 Hockenberry ..... E02F 3/401 171/132
3,431,662 A * 3/1969 Bles ..... E01H 5/065 37/264
3,461,968 A * 8/1969 Longley ..... E02F 3/401 171/132
3,477,573 A * 11/1969 Andersson ..... E02F 3/40 209/260
3,765,490 A * 10/1973 Logue ..... E02F 7/06 171/132
3,904,052 A * 9/1975 Nordstrom ..... E02F 3/407 37/445
4,157,956 A * 6/1979 Robinson ..... B07B 1/10 209/260
4,698,150 A * 10/1987 Wigoda ..... B07B 1/005 171/105
4,698,925 A * 10/1987 Jones ..... E02F 5/326 172/40
4,805,703 A * 2/1989 Carlsson ..... E02F 7/06 171/132
5,172,498 A * 12/1992 Wack ..... E02F 3/405 171/132
5,241,764 A * 9/1993 Modig ..... E02F 3/407 37/405
5,398,430 A * 3/1995 Scott ..... E02F 3/3681 37/142.5
5,581,916 A * 12/1996 Hirose ..... B07B 1/005 209/421
5,771,612 A * 6/1998 Lynch ..... E02F 7/06 172/32
6,375,012 B1 * 4/2002 Leyland ..... E02F 3/407 209/393
6,408,551 B1 * 6/2002 Pettersson ..... B07B 1/12 37/409
8,083,073 B1 * 12/2011 Brown ..... B08B 1/008 209/233
9,080,314 B1 * 7/2015 Rossi, Jr. ..... B07B 1/46

FOREIGN PATENT DOCUMENTS

JP 2005016230 1/2005
SE WO 9012929 A1 * 11/1990 ..... E02F 3/405
WO 9012929 11/1990

OTHER PUBLICATIONS

Search Report for FI20126017 dated Jun. 11, 2013.
International Search Report for PCT/FI2013/050942 dated Jan. 20, 2014.
Written Opinion for PCT/FI2013/050942 dated Jan. 21, 2014.
International Preliminary Report on Patentability for PCT/FI2013/050942 dated Jul. 4, 2014.
Written Opinion for PCT/FI2013/050942 dated Nov. 13, 2014.

* cited by examiner

SCREENED EARTH MOVING BUCKET WITH VIBRATING BARS

CROSS REFERENCE TO RELATED APPLICATIONS

The present application is the U.S. national stage application of International Application PCT/F12013/050942, filed Sep. 27, 2013, which international application was published on Apr. 10, 2014, as International Publication WO2014/053698. The International Application claims priority of Finnish Patent Application 20126017, filed Oct. 1, 2012, the contents of which are incorporated herein by reference in their entireties.

BACKGROUND OF THE INVENTION

The invention relates to a work machine bucket, the bottom of which comprises mutually spaced bars. With a bucket like this it is possible to sort material to be treated according to its grain size.

The invention also relates to use of a work machine bucket in treating and sorting material.

The field of the invention is described in more detail in the preambles of the independent claims of the patent application.

Soil materials may be handled by means of earth-moving machines. An earth-moving machine may be equipped with a screen bucket so that soil material can be sorted during handling. The screen bucket includes a plurality of mutually spaced bars, between which there are gaps of desired size, through which gaps finer material will be able to fall out of the bucket and material having a larger particle size will remain in the bucket. Attempts have been made to enhance the sorting by mounting on the bucket a vibrator that makes the bucket vibrate. However, the conventional screen buckets are found to have shortcomings in efficiency and operation.

BRIEF DESCRIPTION OF THE INVENTION

The object of the present invention is to provide a novel and improved bucket and its use.

The bucket of the invention is characterized in that the bars in the screen part are in transverse direction to the side plates; that the longitudinal axes of the bars in the screen part are straight; and that the vibrator unit is arranged to direct vibrating motion directly to at least one bar in the screen part, whereby said at least one bar to be vibrated moves in relation to the bucket.

The use of the invention is characterized by directing vibration directly to at least one bar in the screen part, the bar being a straight piece and placed transversely to a side plate of the bucket; and making said at least one bar move in relation to the rest of the bucket structure.

The idea is that in the bucket equipped with a screen part and a vibrator unit one or more bars included in the screen part are subjected to vibration. In that case, the one or more bars to be vibrated vibrate in relation to the basic structure of the bucket. The bar is an elongated, straight piece and it is transversal to the side plates of the bucket.

An advantage with the disclosed solution is that sorting efficiency of the screen bucket is improved when vibration acts directly on the bars in the screen. The mass of the transversal bars is relatively small, and consequently the force and energy required for vibration may be small. A further advantage is that when only the transversal bars in the screen are vibrated, the vibrating does not cause significant vibration in the work machine. Thus, the disclosed bucket may improve convenience of use and it may also reduce vibration-related wearing in the boom and other structures of the work machine. Further, the straight transversal bars have a simple structure, and therefore they may also be durable and easy to manufacture.

The idea of an embodiment is that the vibrator unit comprises at least one vibrator device for generating vibration motion and at least one transmission member for transmitting the vibration motion from the vibrator device to at least one bar. The transmission member is an elongated piece that is parallel to the side plates of the bucket. In that case, the transmission member is in transverse direction to the bars of the screen part. The bars are arranged for being supported by the transmission member. The shape of the transmission member may correspond to that of the bottom of the bucket and it may be an elongated, curved, rod-like piece.

The idea of an embodiment is that the transmission member in accordance with the preceding embodiment comprises transverse openings, through which the bars are arranged.

The idea of an embodiment is that the transmission member in accordance with the preceding embodiment comprises transverse openings, through which the bars are arranged. The bars are not attached to the transmission member, i.e. the engagement between the transmission member and the bars does not comprise any separate attachment means. Thus, the bars are able to move freely in relation to the transmission member, at least in their longitudinal direction. This may enhance screening.

The idea of an embodiment is that, in the solution of the preceding embodiment, the transmission member comprises openings that are clearly larger in size than the cross section of the bars, and thus there is a loose fit coupling between the opening in the transmission member and the bar. In that case the bar may turn about its longitudinal axis during screening. This may prevent stones, stumps and other larger particles found in the material to be screened from jamming between the bars in the screen part. The bars may be round in cross section, which facilitates the turning of the bar and further prevents the particles from jamming.

The idea of an embodiment is that the bucket in accordance with any one of the preceding embodiments comprises two vibrator units that are placed at a distance from one another, seen in the transverse direction of the bucket. In addition, the vibrator units are at a transverse distance from the side plates of the bucket. Each vibrator unit comprises a specific vibrator device and a specific transmission member. In that case the bucket comprises two transmission members that are transversal to the bars of the screen part and parallel to the side plates of the bucket. The motion, produced by vibrator devices independent of one another, may be transmitted to end portions of the transversal bars that are substantially straight, elongated pieces. This embodiment enables various manners to move the bars of the screen part.

The idea of an embodiment is that in the bucket according to the preceding embodiment two separate vibrator units are moved in mutually opposite phases such that the vibration motion provided thereby is in mutually opposite directions.

The idea of an embodiment is that in the bucket according to any one of the preceding embodiments the movable, transversal bars of the screen part are located in a space defined by inner surfaces of the side plates of the bucket.

The idea of an embodiment is that in the bucket according to any one of the preceding embodiments the movable bars of the screen part communicate with the basic structure of the bucket only through the vibrator unit. The vibrator unit comprises a transmission member which carries the bars. Thus, the screen part and the bars are not connected by a hinge or articulation to a bottom front or a back plate of the bucket, or to any other basic structure of the bucket, consisting of plate structure.

The idea of an embodiment is that the screen part has a vibrated portion, where the vibration motion from the vibrator unit is directed to every other bar in the vibrated portion. In that case, the vibrated portion has alternately a vibrated bar and a non-vibrated bar.

The idea of an embodiment is that the screen part has a vibrated portion comprising a plurality of adjacent bars which are all vibrated using one or more vibrator units.

The idea of an embodiment is that the screen part has a vibrated portion where adjacent bars are mutually vibrated in the same manner. The vibration motion may be transmitted to the bars to be vibrated from one common vibrator unit.

The idea of an embodiment is that the screen part has a vibrated portion where adjacent bars are vibrated differently in relation to one another. In that case, every second bar may be vibrated using different force, different pace, different frequency, or the direction of the vibration motion may be different. The adjacent bars to be vibrated differently may further improve the sorting capacity of the bucket. In addition, the required vibration effect may be provided using lower intensity of vibration. Further, this solution enables less vibration being conveyed to the work machine.

The idea of an embodiment is that a vibrator device included in the vibrator unit is arranged in the upper part of the bucket, at a distance from the outer surface of the back plate of the bucket. Thus, the vibrator device is not attached to the bottom, side plates or back plate of the bucket. This solution enables placement of the vibrator device in such a way that it is not exposed to damage during use and does not block visibility to the work site. Further, the placing may take into account the feed of driving power, for instance, the placing of hydraulic hoses.

The idea of an embodiment is that the vibrator unit is connected to the structure of the bucket only through the bars in the screen part. In that case, the vibrator unit may be engaged with the bucket through a transmission member, which in turn is engaged with the bars to be vibrated.

The idea of an embodiment is that the vibrator unit comprises a drive shaft that is rotated by at least one rotating motor about its longitudinal axis. The drive shaft may be attached to the back plate of the bucket and the rotating motor may be attached to the side plate. The drive shaft is arranged to drive at least one eccentric by which the generated vibration motion is transmitted, by means of one or more transmission members, to one or more bars included in the vibrated portion. It is possible to arrange the drive shaft to drive two, three or even more eccentrics, whereby it is possible to provide several different vibration movements that can be transmitted by means of the transmission members to appropriate bars. This solution enables one rotating apparatus being utilized in providing several different vibration movements.

The idea of an embodiment is that one or more bars in the portion to be vibrated are equipped with a specific vibrator unit that is arranged to vibrate only one single bar. For instance, it is possible to integrate the vibrator device into the bar structure. The bar may be tubular and the vibrator device may thus be placed inside it. Further, the vibrator device may be placed on the side plate, in connection with the end of the bar, whereby the vibration motion may be transmitted to the bar.

The idea of an embodiment is that the screen part is in the bottom of the bucket. Substantially, the entire bottom of the bucket may constitute the screen part.

The idea of an embodiment is that the screen part is mainly in the bottom of the bucket. The screen part may, however, extend to the back plate as well.

The idea of an embodiment is that the bottom of the bucket comprises at least one solid portion made of plate material and at least one screen part with bars to be vibrated.

The idea of an embodiment is that the size of screen gaps in the screen part may be adjusted by adding or removing bars. The transversal bars in the screen part of the bucket are supported to elongated transmission members parallel to the side plates, which transmission members have openings, transversally to the bucket, for the bars. When necessary, the bars may be pulled longitudinally out of the openings in the transmission members.

The idea of an embodiment is that the size of the screen gaps in the screen part may be adjusted by adding or removing bars. The bars may be supported to the openings in the side plates. Thus, the bar may be removed by pulling it longitudinally away from the bucket, and correspondingly, the bar may be inserted longitudinally into a free opening in the side plate. On the outside of the side plates there may be retaining members, such as plates preventing the bars from sliding out of place during use.

The idea of an embodiment is that the portion to be vibrated only comprises part of the screen part. In the bottom of the bucket, the portion to be vibrated may comprise a portion that is at a distance from a lip plate forming a brim of the bucket. Thus, between the portion to be vibrated and the lip plate there is a screen portion not to be vibrated that comprises a plurality of adjacent bars.

The idea of an embodiment is that the bars in the screen part are round in cross section.

The idea of an embodiment is that the cross section of the bars in the screen part is elliptical, oval or otherwise resembling a flattened circle in shape.

The idea of an embodiment is that the bars in the screen part are rectangular in cross section. In that case the cross section may be a square or a rectangle.

The idea of an embodiment is that the vibrator device is a vibrator motor with an eccentrically arranged weight. When the vibrator motor rotates the eccentric weight about the drive shaft, vibration motion is produced.

The idea of an embodiment is that the vibrator device comprises an impact device which allows generation of linear vibration motion.

The idea of an embodiment is that the vibrator device is a pressure-medium-operated device. Pressure medium is readily available in work machines and their booms, whereby it is simple to arrange feed of driving power to the pressure-medium-operated vibrator device. The vibrator device may operate hydraulically, but in some cases it may also operate by compressed air.

The idea of an embodiment is that the bucket is used for handling and preliminary sorting of soil material. By means of the bucket it is possible to separate stones from soil, or it can be used for separating larger stones from gravel and larger blocks from crushed material.

The idea of an embodiment is that the bucket is an excavator bucket.

The idea of an embodiment is that the bucket is that of a wheel loader, a mini loader, a tractor, a reach truck, an earth moving machine or another work machine.

The above-described applications and features disclosed in connection thereof may be combined to achieve a desired combination of characteristics and features.

BRIEF DESCRIPTION OF THE FIGURES

Some embodiments are explained in more detail in the accompanying drawings, in which.

For the sake of clarity, the figures show some embodiments in a simplified manner. Like reference numerals identify like elements in the figures.

DETAILED DESCRIPTION OF SOME EMBODIMENTS

Figure 1:
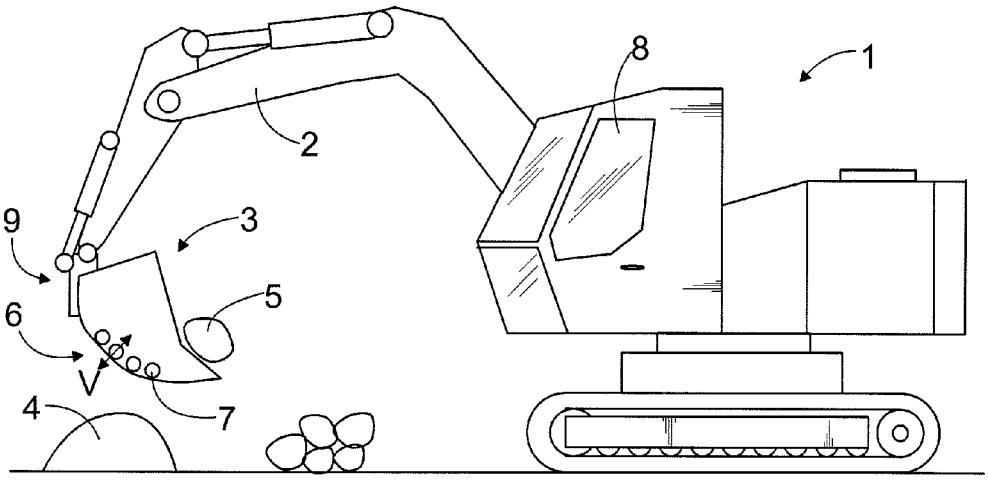
FIG. 1 is a schematic side view of a work machine having a boom equipped with a screen bucket.

FIG. 1 shows a work machine 1 having a boom 2 equipped with a screen bucket 3. The work machine 1 may be an excavator as shown in the figures or it may also be a wheel loader or a corresponding earth-moving machine, or another vehicle employing a bucket. The screen bucket 3 allows transfer and treatment of soil material having particles of various sizes. For instance, the screen bucket 3 may separate larger stones 5, roots and other dispensable material from soil 4 or sand. The screen bucket 3 includes a screen part 6 having a plurality of parallel bars 7. Soil 4 or the like material having a small particle size falls through the gaps between the bars 7 and thus exits the screen bucket 3. Whereas stones 5 or other material having a larger particle size remains in the screen bucket 3 and it may be removed via the bucket orifice after the material of smaller particle size is sorted out. Sorting may be enhanced by vibrating V the bars 7 in the screen bucket 3. Vibrating V of the bars 7 causes substantially less vibration to the boom 2, the cabin 8 and other structures of the work machine 1 than solutions in which the whole bucket is vibrated. Thus, the operational comfort of the screen bucket 3 is better and the structures are subjected to less loading. In addition, because the mass to be vibrated is smaller in the bars 7 than in the whole bucket, sufficient vibration may be achieved by lower vibration force, and consequently vibration means may be smaller in size and less costly in price. FIG. 1 further shows that the bucket 3 comprises engagement members 9 wherewith the bucket 3 may be attached to the boom 2 or other attachment point in the work machine 1.

Figure 2:
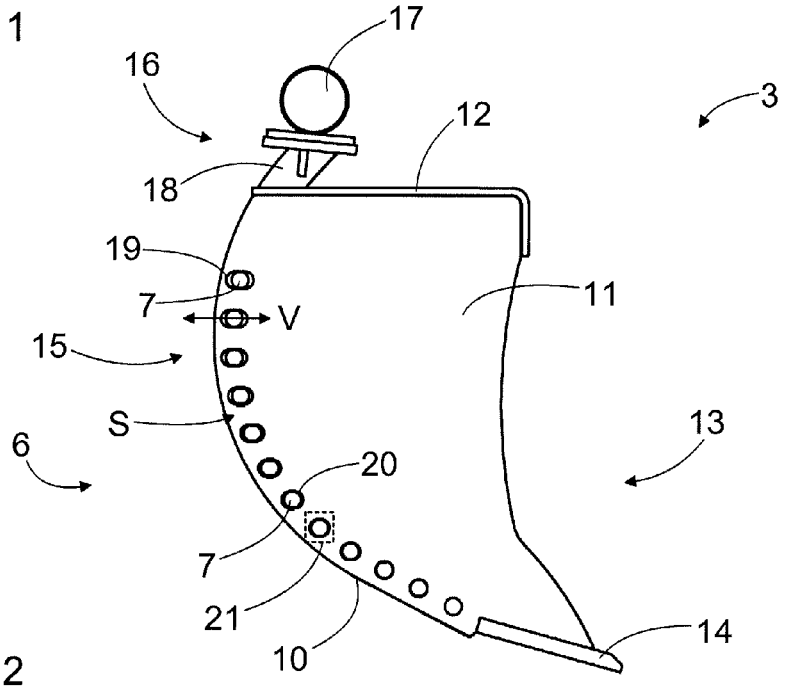
FIG. 2 is a schematic side view of a bucket.

FIG. 2 shows a screen bucket 3 in side view. The bucket 3 comprises a bottom, side plates 11 or side walls and a back plate 12 or a back wall. Further, the bucket 3 has an orifice 13, through which material to be treated is introduced into a cuplike bucket 3, and wherefrom screening reject, i.e. material of larger particle size, is removed at the end of the processing. The bottom 3 of the bucket may be provided with a lip plate 14 in the brim portion of the orifice 13. Typically, the bucket 3 is made of plate material utilizing sheet metal work methods and welding methods.

The bucket 3 is provided with a screen part 6 that may be at the bottom 10. The whole bottom 10 may constitute a screen, whereby the bars 7 form the bottom of the bucket. Alternatively, part of the bottom 10 may be the screen part 6 and part a solid plate structure, for instance. Further, the screen part 6 may extend part of the way up the back plate 12, or the whole back plate, or back surface, may consist of the bars 7. The screen part 6 comprises one or more vibrated portions 15 having one or more bars 7 which are subjected to vibration V by the vibrator unit 16. The vibrator unit 16 comprises a vibrator device 17 whereby vibrating or oscillating motion is produced. In addition, the vibrator unit 16 comprises a transmission member 18 whereby the vibration motion is transmitted to the bars 7 to be vibrated. The transmission member 18 may be, for instance, a rigid rod that is connected to selected bars 7. The vibrator device 17 may be a device based on a rotating, eccentric weight, a device based on linear impact and impact mechanism, or any appropriate device that produces vibrating motion.

Figure 3:
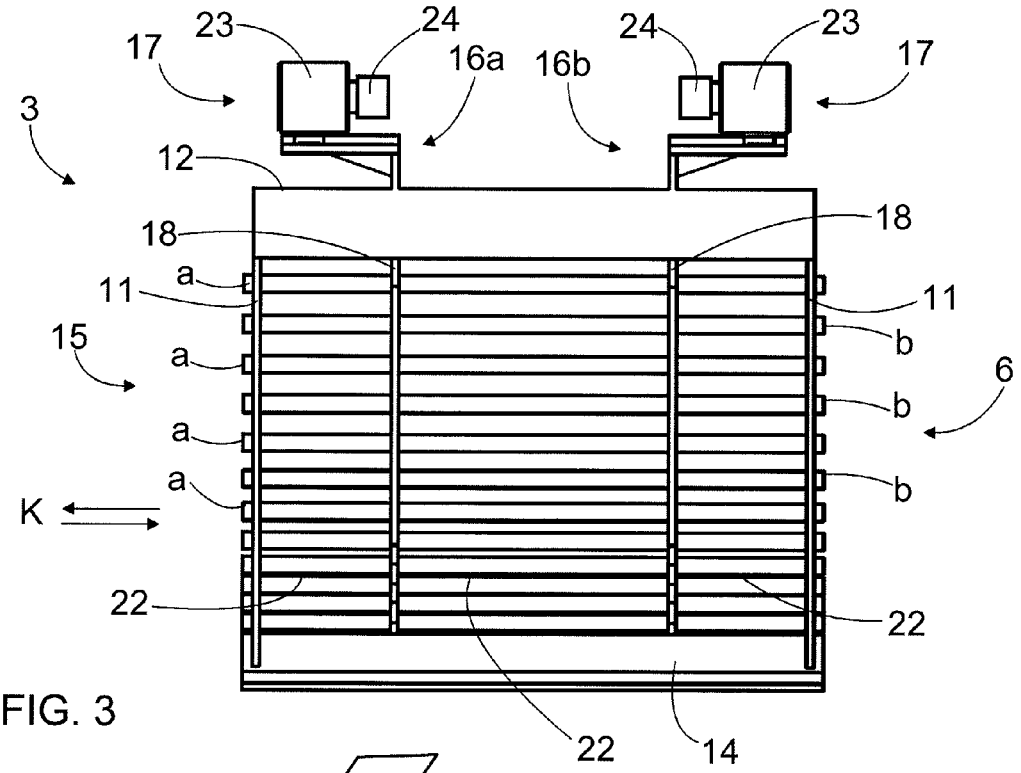
FIG. 3 is a schematic top view of a bucket.

Further still, it can be seen in FIG. 3 that the bars 7 may be arranged through the openings 19, 20 in the side plates 11. Thus, the side plates 11 carry the bars 7. The axial movement of the bars 7 may be prevented by means of retainer members 21. In FIG. 3, the plate serving as the retainer member 21 is illustrated in broken lines. In the vibrated portion 15 the openings 19 in the side plates 11 may be dimensioned larger than the bars 7 so that they do not hinder the vibration motion of the bars 7. Further, the openings 19 may be shaped in view of the vibration motion. When bars having a round cross section are used, the openings 19 may be elongated in shape, for instance oval. The bars not to be vibrated in the screen part 6 may be connected to the side plates 11 with openings 20 having a cross section in accordance with the bars. The size of the screen gaps S in the screen part 6 may be adjusted by removing bars from the bucket 3 or by adding bars thereto. FIG. 3 below illustrates this adjustment by arrows K.

The bucket 3 of FIG. 3 comprises two vibrator units 16*a*, 16*b*, which may be placed at a distance from one another, seen in the transverse direction of the bucket 3. In addition, the vibrator units may be at a distance from the side plates 11. The vibrator units 16*a*, 16*b* may be attached to the bucket 3 through the bars 7 alone, and the lateral position of the vibrator units may be determined by means of tubes 22 arranged around one or more bars. Each vibrator unit 16*a*, 16*b* comprises a vibrator device 17 and a transmission member 18. The vibrator device 17 may comprise a rotating motor 23 which rotates an eccentric weight 24, the rotation of which produces the vibrating effect. The first vibrator unit 16*a* may be connected to vibrate every second bar in the vibrated portion 15, the bars being indicated by reference a, and correspondingly, the second vibrator unit 16*b* may be arranged to vibrate every other bar b. In that case, the vibrated portion 15 may have adjacent bars a and b which are vibrated independently of one another. This makes it possible that the bars a and b may be vibrated at different pace, with different intensity and even in different directions.

Figure 4:
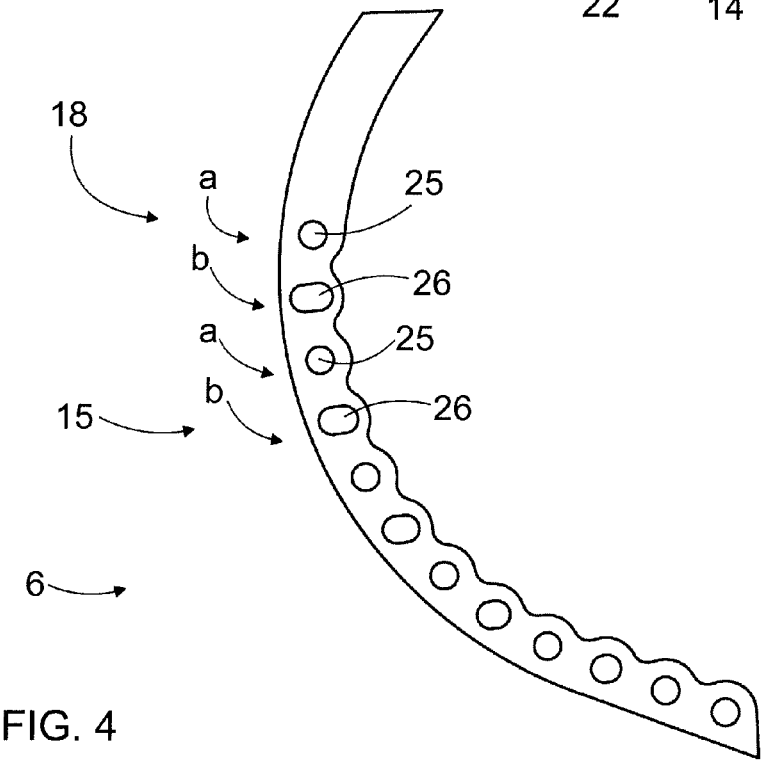
FIG. 4 is a schematic side view of a transmission member by which vibration may be transmitted to bars in a screen part.

FIG. 4 shows a transmission member 18 that may be a rod-like piece the shape of which corresponds to the shape of the bottom of the bucket. Thus, the transmission member 18 may be, for instance, a curved bar as shown in the figure, which bar may be formed by cutting from plate material. The transmission member 18 shown in FIG. 4 may be arranged in a first vibrator unit 16*a* in the arrangement of FIG. 3. In that case, said transmission member 18 transmits vibration motion only to the bars a. In the transmission member 18, at least in the vibrated portion, there are alternately first openings 25 and second openings 26, of which just some are indicated in the figure with reference numerals. The first openings 25 are dimensioned and shaped in accordance with the bars such that the vibration motion is transmitted from the transmission member 18 to the bars a. Whereas, the second openings 26 are dimensioned and shaped such that the vibration motion is not transmitted from the loose openings to the bars b. In the transmission member 18 of the second vibrator unit 16*b* the openings 25, 26 are in reverse order so that the vibration motion is transmitted only to the bars b.

Figure 5:
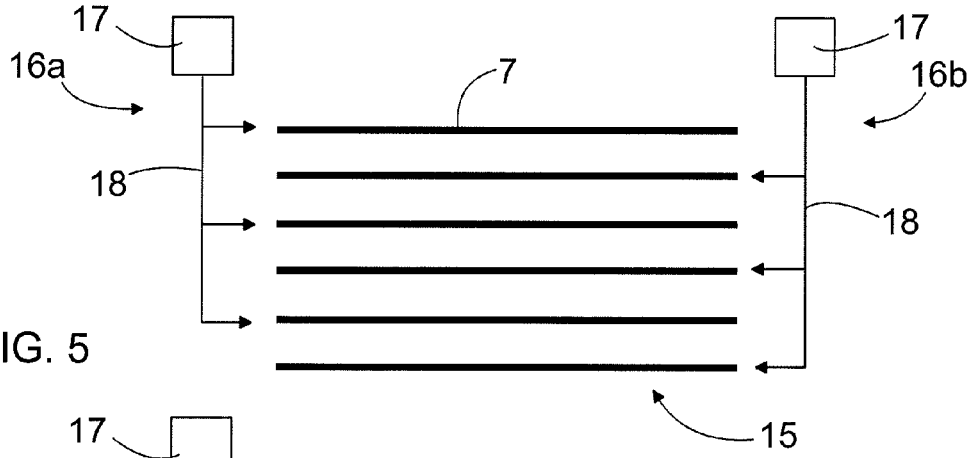
FIGS. 5 to 8 show schematically, and in principle, some alternatives for vibrating bars included in the vibrated portion in the screen part.

FIG. 5 illustrates in a simplified manner the principle of the solution disclosed in FIG. 3, in which every other bar is vibrated by separate vibrator units 16*a*, 16*b*.

Figure 6:
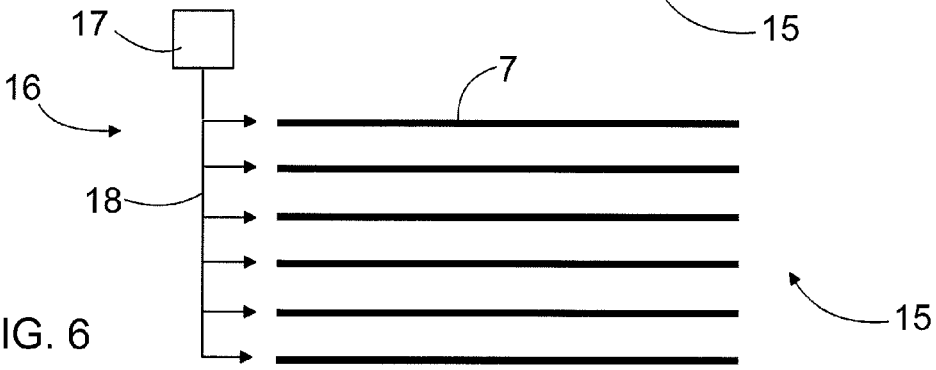

In FIG. 6 the same vibrator unit 16 is arranged to vibrate all the bars comprised by the vibrated part 15.

Figure 7:
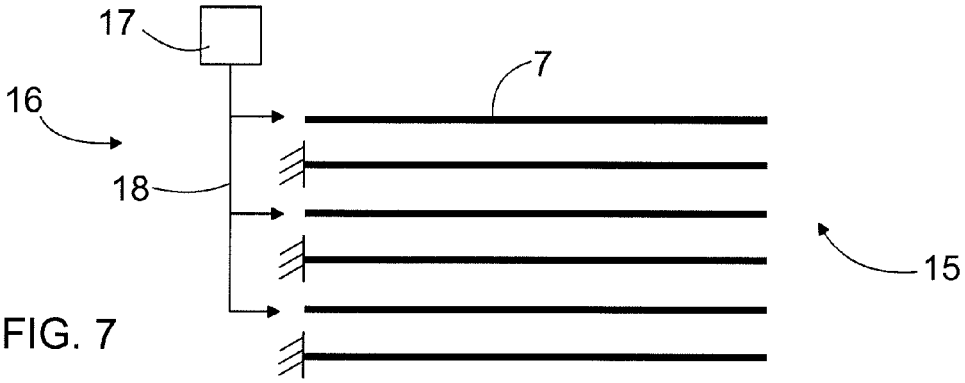

In FIG. 7 every second bar is a bar not to be vibrated and every other bar is vibrated by the vibrator unit 16. The division between the bars to be vibrated and not to be vibrated may also be different.

Figure 8:
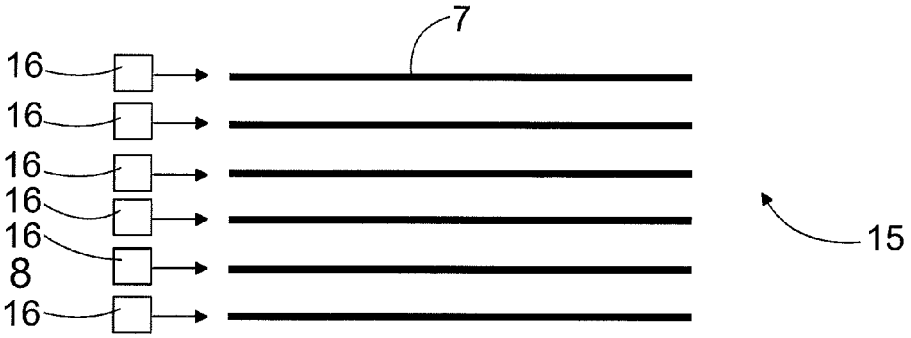

FIG. 8 shows a solution in which each of the bars 7 has a specific vibrator unit 16.

The principles disclosed in FIGS. 5 to 8 may be combined and modified so that the bucket 3 will have exactly the desired vibrated portion 15, or a plurality of vibrated portions.

In some cases, features disclosed in this application may be used as such, regardless of other features. On the other hand, when necessary, features disclosed in this application may be combined in order to provide different combinations.

The drawings and the related description are only intended to illustrate the idea of the invention. Details of the invention may vary within the scope of the claims.

The invention claimed is:

1. A bucket comprising:

a bottom;

side plates on opposite edges of the bottom;

a back plate;

engagement members wherewith the bucket is connectable to a work machine;

at least one screen part which comprises a plurality of bars arranged at a distance from one another in such a way that between adjacent bars there will be screen gaps and the bars form a screen;

at least one vibrator unit for directing vibration to the bucket;

and wherein the plurality of bars in the screen part are in transverse direction to the side plates;

longitudinal axes of the plurality of bars in the screen part are straight; and the vibrator unit is arranged to direct vibrating motion directly to at least one bar of the plurality of bars in the screen part, whereby the at least one bar to be vibrated moves in relation to the bucket;

the vibrator unit comprises at least one vibrator device for generating vibration motion and at least one transmission member connected to the vibrator device for transmitting vibration motion from the vibrator device directly to the at least one bar to be vibrated;

the transmission member is parallel to the side plates and is movable relative to the side plates by means of the vibrator device and comprises a plurality of openings through which at least some of the plurality of bars in the screen part are arranged; and the engagement between the transmission member and each of the at least some of the bars in the screen part is without rigid attachment, whereby each of the at least some of the bars in the screen part is allowed to vibrate relative to the transmission member during operation of the vibrator device.

2. The bucket of claim 1, wherein the screen part includes a vibrated portion which comprises the plurality of bars; and adjacent bars within the plurality of bars in the vibrated portion are arranged for being vibrated in a different manner with respect to one another.

3. The bucket of claim 1, wherein the screen part includes a vibrated portion which comprises the plurality of bars; and adjacent bars within the plurality of bars in the vibrated portion are arranged for being vibrated in a different manner with respect to one another;

the bucket comprises two vibrator units; and the first vibrator unit is arranged to vibrate every second bar in the vibrated portion, and the second vibrator unit is arranged to vibrate every other bar.

4. The bucket of claim 1, wherein the transmission member is an elongated piece parallel to the side plates of the bucket; and the shape of the transmission member corresponds to that of the bottom of the bucket.

5. The bucket of claim 1, wherein the plurality of openings in the transmission member comprises several alternating first openings and second openings, through which the at least some of the bars in the screen part are arranged;

each of the first openings is shaped and dimensioned to correspond to the contour of the bar of the at least some of the bars arranged through the first opening, whereby the first opening transmits the vibration motion to the bar; and each of the second opening is shaped and dimensioned to be larger than the contour of the bar of the at least some of the bars arranged through the second opening, whereby the second opening does not transmit the vibration motion to the bar.

6. The bucket of claim 1, wherein the bucket comprises a plurality of openings through the side plates;

at least one bar of the plurality of bars in the screen part is removable by pulling the bar longitudinally from the bucket, and correspondingly, is mountable by inserting it longitudinally into place through one of the plurality of openings through the side plates; and the size of the screen gaps in the screen part is adjustable by adding or removing bars.

7. The bucket of claim 1, wherein the bucket comprises two separate vibrator units, each including a vibrator device and a transmission member;

the transmission members of the vibrator units are located at a transversal distance of the bucket from one another and they are parallel to the side plates of the bucket; and the transmission members are furnished with a plurality of transversal openings, through which the bars are arranged.

8. Use of a bucket, wherein is employed a bucket which comprises at least one screen part having a plurality of bars arranged at a distance from one another in such a way that between adjacent bars there will be screen gaps;

and wherein the bucket is attached to a boom of a work machine by means of engagement members;

and wherein the bucket is used for shifting material containing particles of different sizes and for its simultaneous sorting on the basis of the particle size;

and wherein the bucket is subjected to vibration by means of a vibrator unit during the handling of the material;

and utilizing the bucket, which is according to claim 1;

directing the vibration directly to at least one bar in the screen part, which bar is a straight piece and placed transversally to the side plate of the bucket; and making the at least one bar vibrate in relation to the rest of the structure of the bucket.

9. The use as claimed in claim 8, comprising adjusting the size of screen gaps in the screen part by adding and removing bars in the screen part; and moving the bar during the adjustment mainly in its longitudinal direction.

* * * * *